US011391044B2

(12) United States Patent
Cherniakov

(10) Patent No.: US 11,391,044 B2
(45) Date of Patent: Jul. 19, 2022

(54) MODULAR PARTITION AND FABRICATION THEREOF

(71) Applicant: Innovatus Design Pty Ltd, Darling Point (AU)

(72) Inventor: Daniel Cherniakov, Darling Point (AU)

(73) Assignee: Innovatus Design Pty Ltd., New South Wales (AU)

( * ) Notice: Subject to any disclaimer, the term of this patent is extended or adjusted under 35 U.S.C. 154(b) by 0 days.

(21) Appl. No.: 17/020,540

(22) Filed: Sep. 14, 2020

(65) Prior Publication Data

US 2021/0079649 A1 Mar. 18, 2021

(51) Int. Cl.

| | |
|---|---|
| ***E04C 2/34*** | (2006.01) |
| ***E04B 2/74*** | (2006.01) |
| ***E04B 2/72*** | (2006.01) |

(52) U.S. Cl.

CPC ..... *E04B 2/7407* (2013.01); *E04B 2/721* (2013.01); *E04B 2002/7487* (2013.01); *E04B 2103/04* (2013.01); *E04C 2/3405* (2013.01)

(58) Field of Classification Search

CPC ..... E04C 2/3405; E04C 2002/345; E04C 2002/3455; E04C 2/34; B32B 3/28;

(Continued)

(56) References Cited

U.S. PATENT DOCUMENTS

| | | | | |
|---|---|---|---|---|
| 2,576,530 A | | 11/1951 | Medal | |
| 3,819,466 A | * | 6/1974 | Winfield | B32B 3/28 428/175 |
| 3,975,882 A | * | 8/1976 | Walter | E04C 2/40 52/571 |

(Continued)

FOREIGN PATENT DOCUMENTS

| | | |
|---|---|---|
| CH | 509512 A | 6/1971 |
| CN | 105350709 A | 2/2016 |

(Continued)

*Primary Examiner* — Brent W Herring

*Assistant Examiner* — Daniel J Kenny

(74) *Attorney, Agent, or Firm* — Eandi Fitzpatrick LLP

(57) ABSTRACT

A modular device adapted for subdividing room space, the modular device comprising: a panel comprising a corrugated portion positioned between a first planar surface and a second planar surface of the panel, wherein the peaks of the corrugated portion are in engagement with the first planar surface, wherein the troughs of the corrugated portion are in engagement with the second planar surface; the first planar surface and the second planar surface each having a first end and a second end; wherein the first and second ends of the first planar surface are respectively opposite relatively to the first and second ends of the second planar surface; the second planar surface is parallel to the first planar surface; wherein the corrugations are is parallel to the vertical axis of the panel; a concave female portion positioned along the vertical axis in the panel, wherein the concave female portion is formed from at least: the first end of the first planar surface, the first end of the second planar surface, and a curved portion from the corrugated portion; a convex male portion positioned along the vertical axis of the panel, wherein the convex male portion is positioned outside of the second end of the first planar surface and the second end of the second planar surface; wherein to extend the length of the panel, the convex male portion of a first panel is adapted to engage with the concave female portion of a second panel.

16 Claims, 9 Drawing Sheets

(58) Field of Classification Search
CPC ..... B32B 2607/00; B32B 29/08; Y10T 428/24694; E04B 2/7407; E04B 2/721; E04B 2002/7487; E04B 2103/04
See application file for complete search history.

(56) References Cited

U.S. PATENT DOCUMENTS 4,028,859 A * 6/1977 Bellagamba ..... E04C 2/292 52/393
4,070,839 A * 1/1978 Clem ..... E04B 1/66 52/448
4,121,645 A * 10/1978 Behr ..... A47G 5/00 16/365
4,185,430 A * 1/1980 Gartung ..... E04B 2/7425 52/239
4,344,475 A 8/1982 Frey
4,443,987 A * 4/1984 Erb ..... E04C 2/543 52/309.1
4,942,709 A * 7/1990 Waldron ..... E04B 2/7425 52/285.1
5,290,622 A * 3/1994 Tanabe ..... B32B 3/28 428/182
5,348,778 A * 9/1994 Knipp ..... B32B 3/06 312/400
5,642,593 A 7/1997 Shieh
D383,554 S * 9/1997 Hart ..... D25/102
7,172,865 B2 * 2/2007 Heyduk ..... G01N 33/542 435/6.1
D888,286 S * 6/2020 Spear ..... D25/138
2012/0000583 A1 1/2012 Cik
2014/0013686 A1 1/2014 Langdon

FOREIGN PATENT DOCUMENTS

CN 205348551 U 6/2016
EP 0025420 A1 * 3/1981
FR 2204204 A7 5/1974
WO 2014120836 A1 8/2014

* cited by examiner

MODULAR PARTITION AND FABRICATION THEREOF

CROSS-REFERENCE TO RELATED APPLICATION

This application claims priority under the Paris Convention to Australian Patent Application no. AU2019903470 filed in Australia on Sep. 18, 2019, all contents of which are hereby expressly incorporated by reference.

FIELD OF THE INVENTION

The present invention relates to room or space divider devices or partitions. More particularly, it is a partition interconnection device for use as non-structural walls which extend between the floor and the ceiling of the room.

BACKGROUND

Buildings typically include large open areas which can be divided into smaller room spaces by any of a number of space divider and panel systems that have been developed. These space divider arrangements typically use upright space-dividing wall panels which connect together to subdivide the room area into a plurality of smaller workstations of desired size and configuration. Such panels, especially for office areas, are typically less than floor to ceiling height. Typically, a plurality of upright space dividing wall panels is used which serially connect together panels together. These systems use straight connectors, which are typically used as a separate piece to connect together serial panels together. Introduction of additional components such as straight connectors add to the inconvenient fabrication costs for the purpose extending panel length.

Other conventional panels for use in dividing space are instalment of solid panels. Such panel systems tend to be rather costly due to increased material used in the fabrication of the solid panels and are heavy and difficult to install. An example of partitioning system is described in U.S. Pat. No. 4,344,475.

Other existing panel systems typically include heavy, rigid frames made from frame members which are cut to a pre-measured length and permanently welded to one another. Additionally, the panel frames typically include a large number of additional components for attaching the panel frames to one another, and also for attaching the panel to the ceiling of the room space. The large amount of different parts increases both the cost and the difficulty of manufacturing and installing existing floor to ceiling panel systems. As a result of the complexity of the design of existing floor to ceiling wall panel systems, the installation and removal of the panel generally requires trained and experienced workers such that modifications to the configuration of the panel system cannot easily be made. An example of a rigid partitioning system is described in U.S. Pat. No. 5,642,593.

There is a long felt need to provide a wall panel system which includes a minimal number of components to serially connect the panels which is easy to install to a desired surface.

Any discussion of the prior art throughout the specification should in no way be considered as an admission that such prior art is widely known or forms part of common general knowledge in the field.

SUMMARY

Problems to be Solved

It is an aim and objective of the present invention to provide an improved modular device for dividing room space.

It may be advantageous to provide a modular device with a corrugated portion for reinforcing the strength of the planar surfaces of the panel.

It may be an advantage to provide a modular device that can mate or connect serially with another corresponding modular device.

It may be an advantage to provide a further reinforcement material between the corrugation portion and the planar surfaces of the panel for increasing the rigidity of the panel.

It may be an advantage to provide a low cost settable polyurethane foam which can become solid between the corrugation portion and the planar surfaces of the panel.

It may be an advantage to provide a panel constructed from a substantial amount of recycled or recyclable materials.

It may be an advantage to provide a base plate for use on the panel for securing the panel to the floor or a platform or a flat surface.

It may be an advantage to provide a corner piece for changing the direction of the panel extension.

It may be an advantage to provide a complementary male terminal cap for rendering the last panel as a smooth rectangular piece.

It may be an advantage to provide a complementary female terminal cap for rendering the front panel as a smooth rectangular piece.

It is an object of the present invention to overcome or ameliorate at least one of the disadvantages of the prior art, or to provide a useful alternative.

Means for Solving the Problem

A first aspect of the present invention may relate to a modular device adapted for subdividing room space, the modular device may comprise a panel comprising a corrugated portion which may be positioned between a first planar surface and a second planar surface of the panel. The peaks of the corrugated portion may be in engagement with the first planar surface and the troughs of the corrugated portion may be in engagement with the second planar surface. The first planar surface and the second planar surface may each have a first end and a second end. The first and second ends of the first planar surface are respectively opposite relatively to the first and second ends of the second planar surface. The second planar surface may be parallel to the first planar surface and the corrugations may be parallel to the vertical axis of the panel. A concave female portion may be positioned along the vertical axis in the panel, wherein the concave female portion may be formed from at least: the first end of the first planar surface, the first end of the second planar surface, and a curved portion from the corrugated portion. A convex male portion may be positioned along the vertical axis of the panel, wherein the convex male portion may be positioned outside of the second end of the first planar surface and the second end of the second planar surface, wherein to extend the length of the panel, the convex male portion of a first panel may be adapted to engage with the concave female portion of a second panel.

Preferably, the modular device may further comprise a male cap, wherein the male cap may be adapted to cover the female portion of the last panel.

Preferably, the modular device may further comprise a corner portion, wherein the corner portion may comprise a female corner cap and an adjacent male part; wherein the female corner cap may be adapted to engage with the male portion of the front panel, wherein the adjacent male part may be adapted to engage with the female portion of the next panel; and wherein the adjacent male part may be extended outwardly from an outer surface of the female cap at an angle relative to the longitudinal axis of the length of the panel.

Preferably, the angle may be 90° relative to the longitudinal axis of the length of the panel.

Preferably, the modular device may further comprise an elongated base plate adapted for attaching to a base of the panel, wherein the length of the elongated base plate may be shorter than the length of the base of the panel.

Preferably, the elongated base plate may have a first end and a second end, wherein the first end of the base plate may be adapted to engage with a first end of the base of the panel, wherein the female portion of the panel may be outside the first end of the base plate.

Preferably, the second end of the base plate may be adapted to engage with a second end of the base of the panel, wherein the male portion of the panel may be outside the second end of the base plate.

Preferably, the base plate may comprise a plurality of legs extending perpendicularly away from the longitudinal axis of the base plate, wherein each leg of the plurality of legs has a floor securing means.

Preferably, the panel may be constructed from at least one polymer selected from the group of: acrylonitrile butadiene styrene, polyethylene, polycarbonate, polyamide, high impact polystyrene, and polypropylene.

Preferably, the female portion may further comprise a securing means positioned in the female portion.

Preferably, the modular device may further comprise an elongate U bracket or U shaped bracket along the longitudinal axis of the panel, wherein a base of the U bracket may be mountable to the ceiling of room space, and wherein the arms of the U bracket may be adapted to secure with the top of the panel.

Preferably, the panel may be formed form at least one selected from the group of: extrusion, and injection moulding.

Preferably, the modular device may further comprise a panel reinforcement positioned between the first planar surface and the second planar surface, wherein the panel reinforcement may be polyurethane foam.

Preferably, the sinusoidal wavelength to amplitude ratio of the corrugation may be in the range of: 1:1 to 3:1.

Preferably, the sinusoidal wavelength to amplitude ratio of the corrugation may be 2:1.

Preferably, the height of the panel may be in the range of: 1 metre to 3 metres, the length of the panel may be in the range of: 1 metre to 4 metres, and the thickness of the panel may be in the range of: 20 millimetres to 80 millimetres.

Preferably, the height of the panel may be 1 metre, the length of the panel may be 2.4 metres, and the thickness of the panel may be 50 millimetres.

DESCRIPTION OF THE INVENTION

Figure 1A:
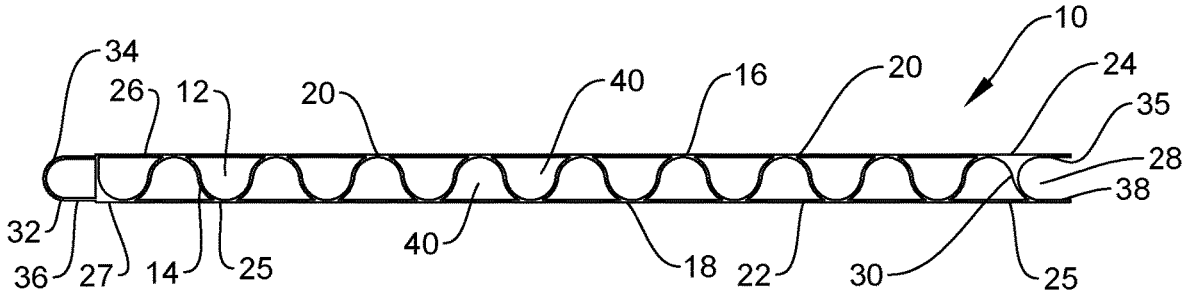
FIG. 1A illustrates a top view of a modular device in accordance with a first preferred embodiment of the present invention.

Preferred embodiments of the invention will now be described with reference to the accompanying drawings and non-limiting examples. It should be noted in the following description that like or the same reference numerals in different embodiments denote the same or similar features.

Figure 1B:
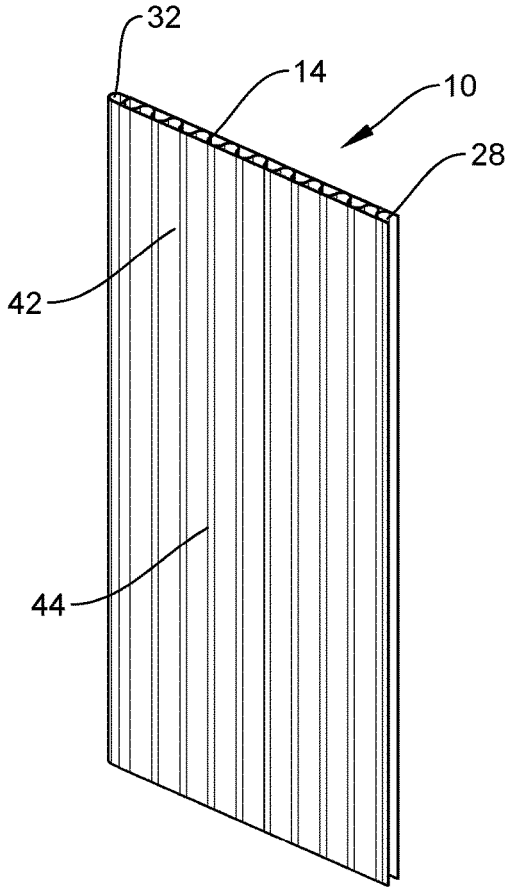
FIG. 1B illustrates a perspective view of the modular device of FIG. 1A.
Figure 1C:
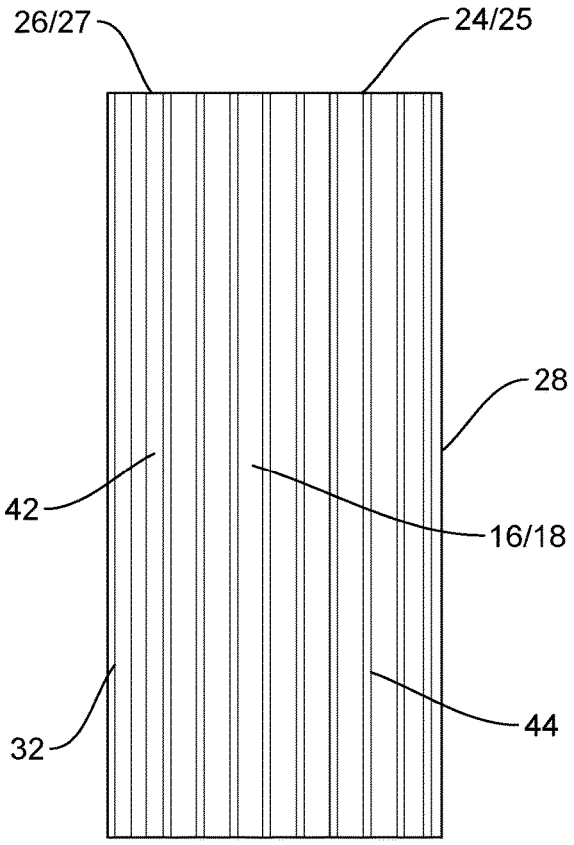
FIG. 1C illustrates a front view of the modular device of FIG. 1B.

In an embodiment of the present invention, as illustrated in FIGS. 1A to 1C, FIG. 1A shows a top view of a modular device 10 according to a preferred embodiment of the present invention. The modular device 10 may be adapted for subdividing room space. The modular device 10 may comprise a panel 12. The panel 12 may be elongated. The panel 12 may comprise a corrugated portion 14 which may be positioned between a first planar surface 16 and a second planar surface 18 of the panel 12. The peaks 20 of the corrugated portion 14 may be in engagement with the first planar surface 16 and the troughs 22 of the corrugated portion 14 may be in engagement with the second planar surface 18. The first planar surface 16 and the second planar surface 18 may each have a first end 24, 25 and a second end 26, 27. The first 24 and second ends 25 of the first planar surface 16 are respectively opposite relatively to the first 26 and second ends 27 of the second planar surface 18. The first end of the first planar surface 24 may be opposite relatively to the first end of the second planar surface 25, and the second end of the first planar surface 26 may be opposite relatively to the second end of the second planar surface 27. The second planar surface 18 may be parallel to the first planar surface 16, where in the corrugations 14 may run parallel to the vertical axis of the panel 12.

A female portion 28 may be positioned along the vertical axis in the panel 12. The first planar surface 16 and the second planar surface 18 may each have a certain thickness. The first planar surface 16 may comprise an outer planar surface and an inner planar surface, and the second planar surface 18 may comprise an outer planar surface and an inner planar surface. The female portion 28 may be formed from at least: the first end of the first inner planar surface 35, the first end of the second inner planar surface 37, and a curved portion 30 from the corrugated portion 14. The female portion 28 may have a concave profile.

Figure 4A:
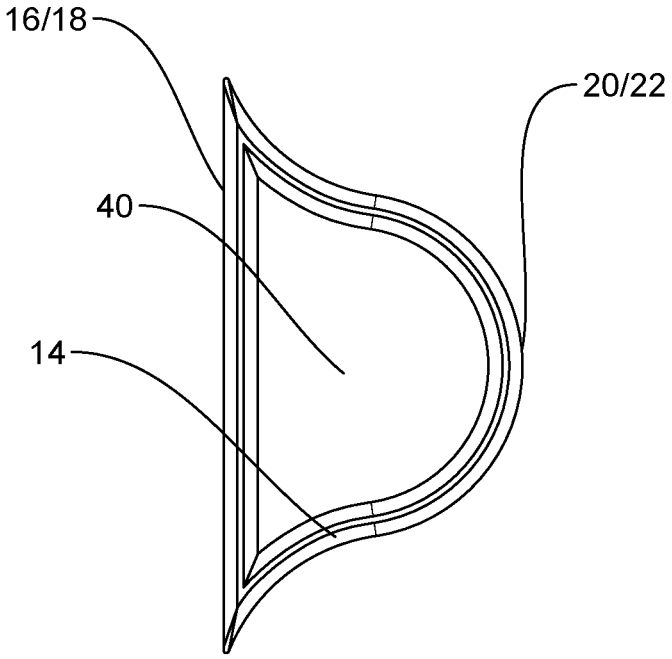
FIG. 4A illustrates a top view of a portion of the corrugated portion of the modular device of FIG. 1A.
Figure 4B:
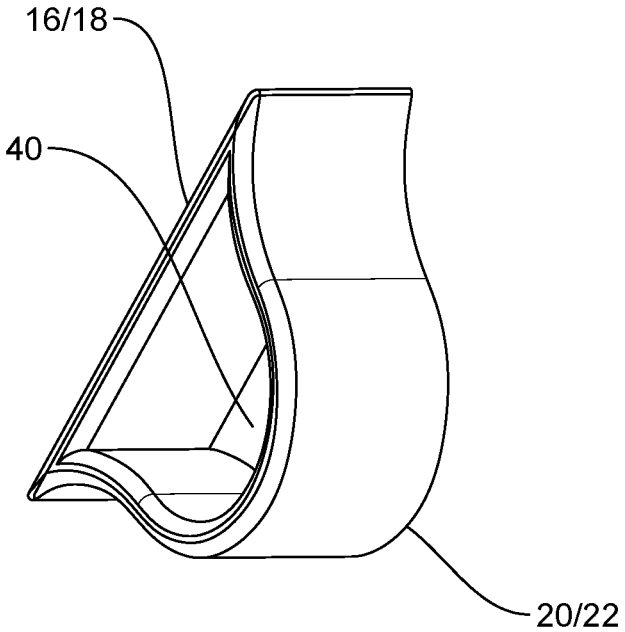
FIG. 4B illustrates a perspective view of FIG. 4A.

A male portion 32 may be positioned along the vertical axis of the panel 12, wherein the male portion 32 may be positioned outside of the second end of the first planar surface 26 and the second end of the second planar surface 27. The male portion 32 may have a convex profile outside of the second ends of the first planar and second planar surfaces. For extending the length of the panel 12, the convex male portion 32 of a first panel 12 may be adapted to engage with the concave female portion 28 of a second panel 12. The first side of the male portion 34 may be engaged with a first side of the female portion 35, and a second side of the male portion 36 may be engaged with a second side of the female portion 37. Engagement of the convex male portion 32 and the concave female portion 32 may be such that the outer surface of the first planar surface of the second panel may be flush with the outer surface of the first planar surface of the first panel. Similarly, the outer surface of the second planar surface of the second panel may be flush with the outer surface of the second planar surface of the first panel. It may be preferred that the outer surface of the first planar surface 16 and the outer surface of the second planar surface 18 may be smooth. As illustrated in FIGS. 4A and 4B, the modular device 10 may have corrugated spaces 40 between the corrugation portion 14 and the first and second planar surfaces 16, 18. As shown in FIGS. 1B and 1C, the modular device 10 may also have top portion 42 and a bottom portion 44.

Figure 5A:
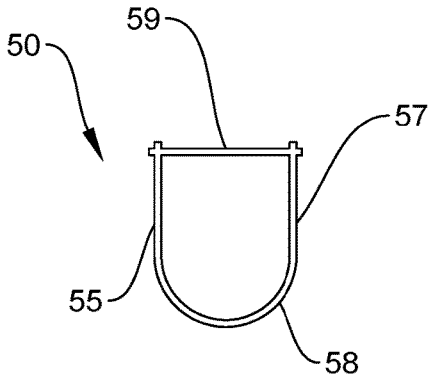
FIG. 5A illustrates a top view of a male cap for engaging with a female portion of the modular device of FIG. 1A.
Figure 5B:
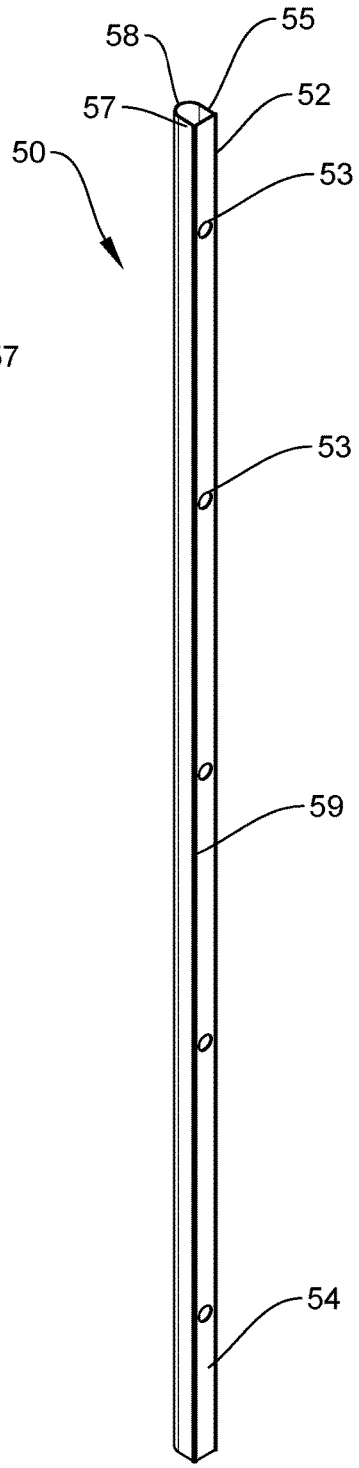
FIG. 5B illustrates a perspective view of FIG. 5A.
Figure 5C:
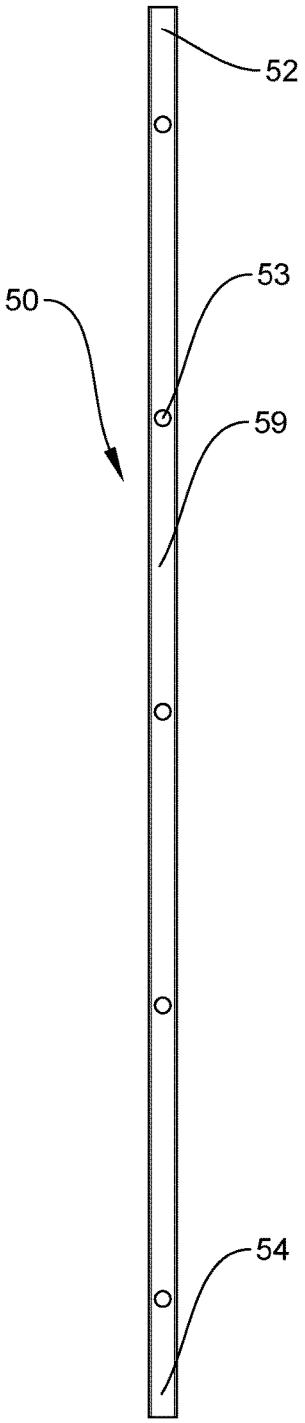
FIG. 5C illustrates a back view of FIG. 5A.
Figure 9A:
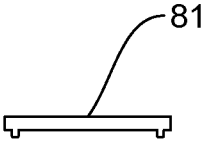
FIG. 9A illustrates a top view of the end portions.
Figure 9B:
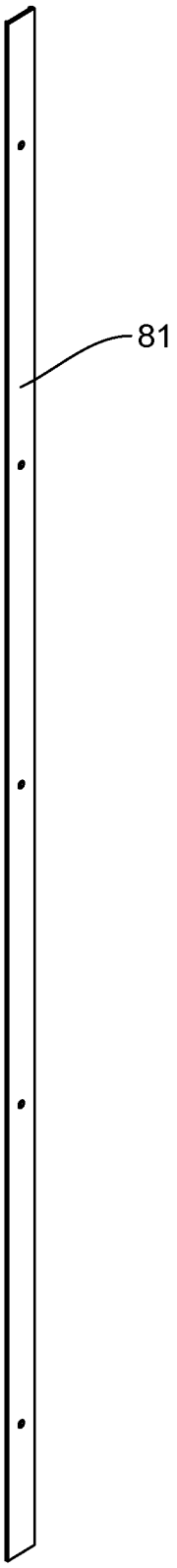
FIG. 9B illustrates a perspective view of FIG. 9A.
Figure 9C:
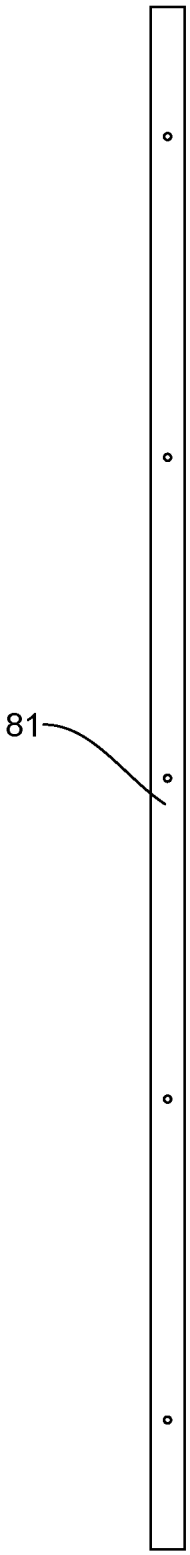
FIG. 9C illustrates a back view of the FIG. 9A.

As illustrated in FIG. 5A to 5C, to terminate the panel length of the last panel which has an open female portion 28, the concave female portion 28 may be covered by a male cap 50. The male cap 50 may have a first side 55, a second side 57, and a curved portion 58. The first side of the male portion 55 may be engaged with a first side of the female portion 35, the second side of the male portion 57 may be engaged with a second side of the female portion 37, and the curved male cap portion 58 may be engaged with a curved portion of the female portion 30. The male cap 50 may have a vertical plate 59 which may cover the concave opening of the female portion 28. As also shown in FIGS. 9A and 9C, the vertical plate 59 may have an upper end 52 and a lower end 54 for covering the upper part of the modular device 42 and the lower part of the modular device 44 respectively. The vertical plate 59 may also have a plurality of fasteners along the vertical axis of the vertical plate 59 for securing the vertical plate 59 with a solid material enclosed by a first side 55, a second side 57, a curved portion 58 and the vertical plate 59.

Figure 2A:
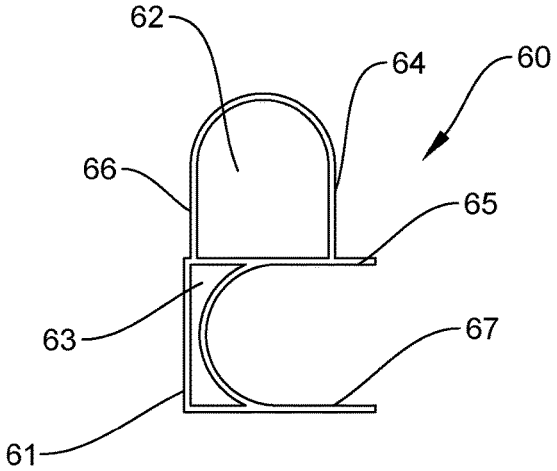
FIG. 2A illustrates a top view of a corner portion for engaging with the modular device of FIG. 1A.
Figure 2B:
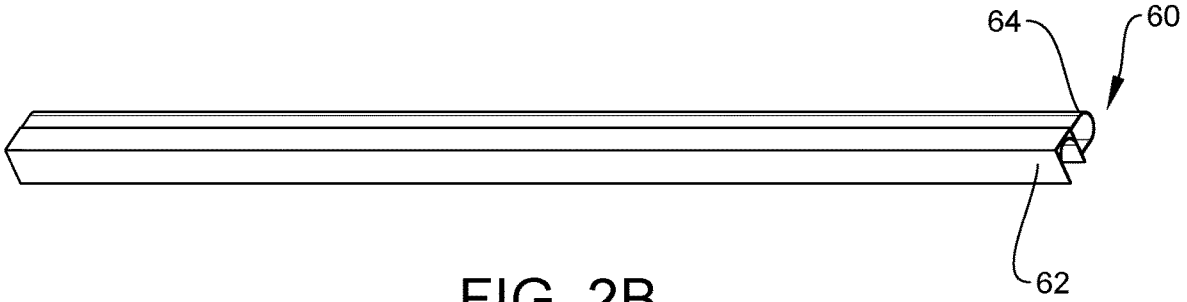
FIG. 2B illustrates a perspective view of the corner portion of FIG. 2A.
Figure 3A:
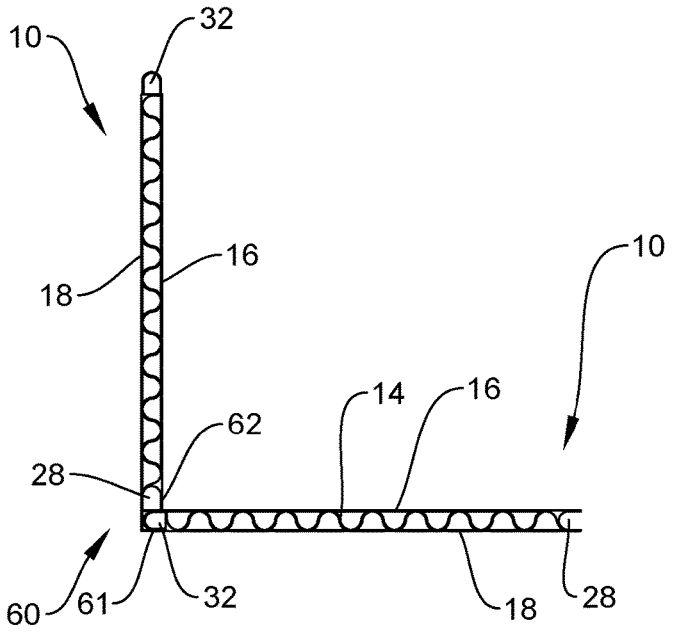
FIG. 3A illustrates a top view of the corner portion of FIG. 2A with the corner male portion engaged with a female portion of a modular device of FIG. 1A and the corner female portion engaged with a male portion of another modular device of FIG. 1A.
Figure 3B:
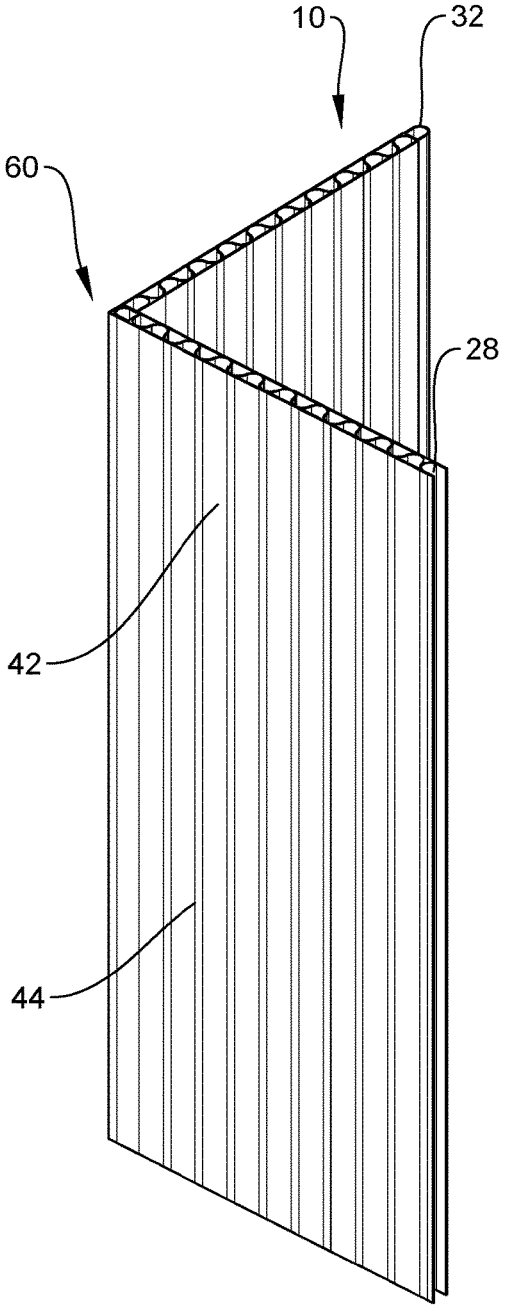
FIG. 3B illustrates a perspective view of FIG. 3A.

As illustrated in FIGS. 2A and 2B, the modular device 10 may further comprise a corner portion 60, wherein the corner portion 60 may comprise a female corner cap 61 and an adjacent male part 62. The female corner cap 61 may be adapted to engage with a male portion 32 of a panel 12, wherein the adjacent male part 62 may be adapted to engage with the female portion of another panel 12. The adjacent male part 62 may extend outwardly from an outer surface of the female cap 61 at an angle relative to the longitudinal axis of the length of the panel 12. It may be preferred that for a corner, the angle may be 90° relative to the longitudinal axis of the length of the panel 12. Engagement of the corner portion 60 with two panels 12 are illustrated in FIGS. 3A and 3B. The female corner cap 61 may have a first side 65 for engaging with a first side of male portion 34 of the panel 12 and the female cap 61 may have a second side 67 for engaging with a second side of male portion 36 of the panel 12. The adjacent male part 62 may have a first side 64 for engaging with a first side of the female portion 35 of the panel 12 and the adjacent male part 62 may have a second side 66 for engaging with a second side of the female portion 37 of the panel 12. The female corner cap 61 may have space 63, in which it may be filled with a structurally reinforcing material such as a polyurethane foam. It may be appreciated that any type of structurally reinforcing material can be used.

Figure 6A:
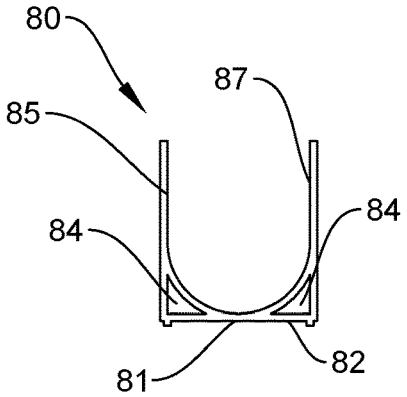
FIG. 6A illustrates a top view of a female cap for engaging with a male portion of the modular device of FIG. 1A.
Figure 6B:
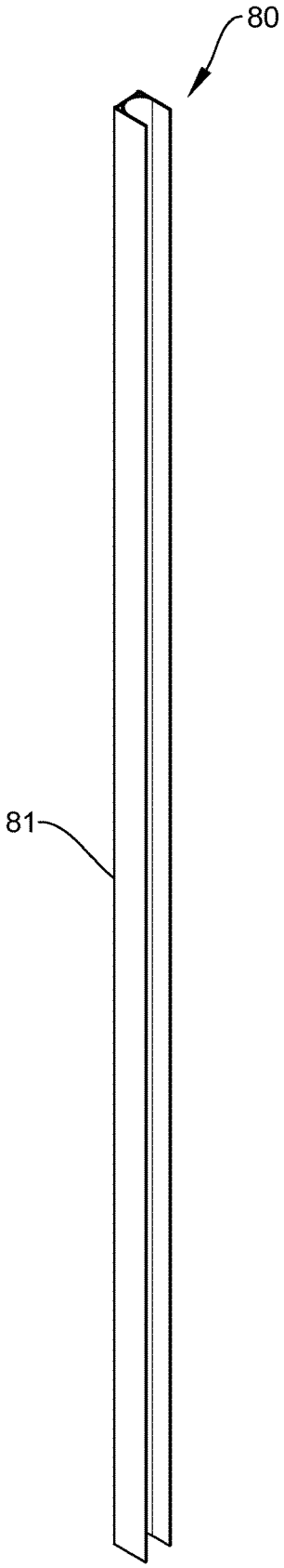
FIG. 6B illustrates a perspective view of FIG. 6A.
Figure 6C:
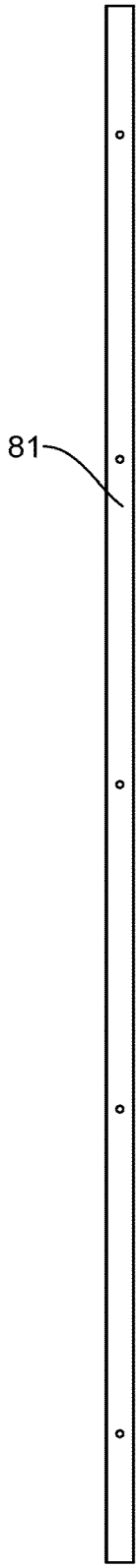
FIG. 6C illustrates a front view of FIG. 6A.

Similar to the female cap 61 of the female corner cap 60, there may a terminal female cap 80 as illustrated in FIGS. 6A to 6C. The terminal female cap 80 may be used for capping the male portion 32 of the front panel 12. The terminal female cap 80 may have a first side 85 for engaging with a first side of the male portion 34 of the front panel 12 and a second side 87 for engaging with a second side of the male portion 36 of the front panel 12. The peak of the concave female cap 61 may be in communication with the vertical plate 81 of the terminal female cap 80. There may be gaps 84 formed between the curve of the concave female cap, the outer surface of the terminal female cap and the vertical plate 81. The gaps 84 may be filled with a structurally reinforcing material which may also be polyurethane foam.

Figure 8A:
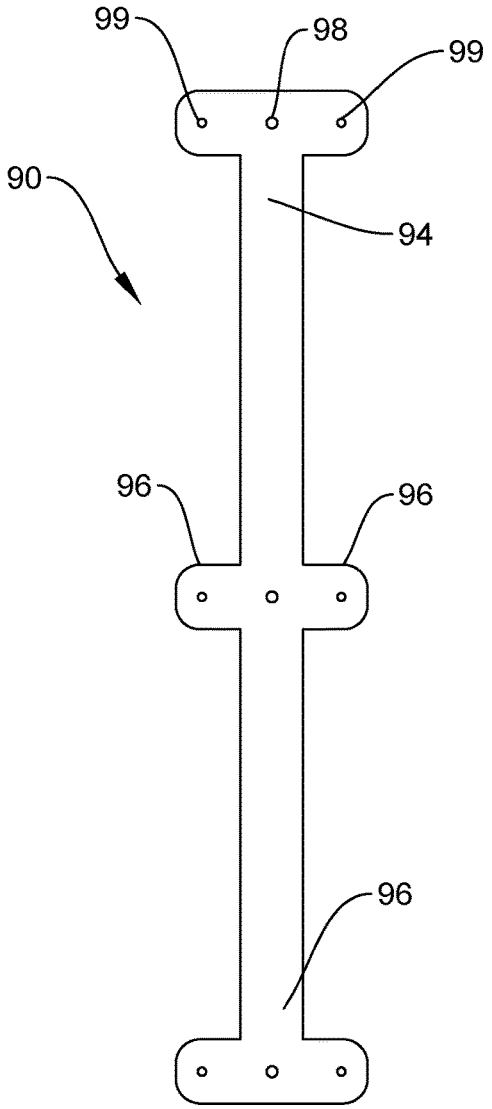
FIG. 8A illustrates a top view of the base plate.
Figure 8B:
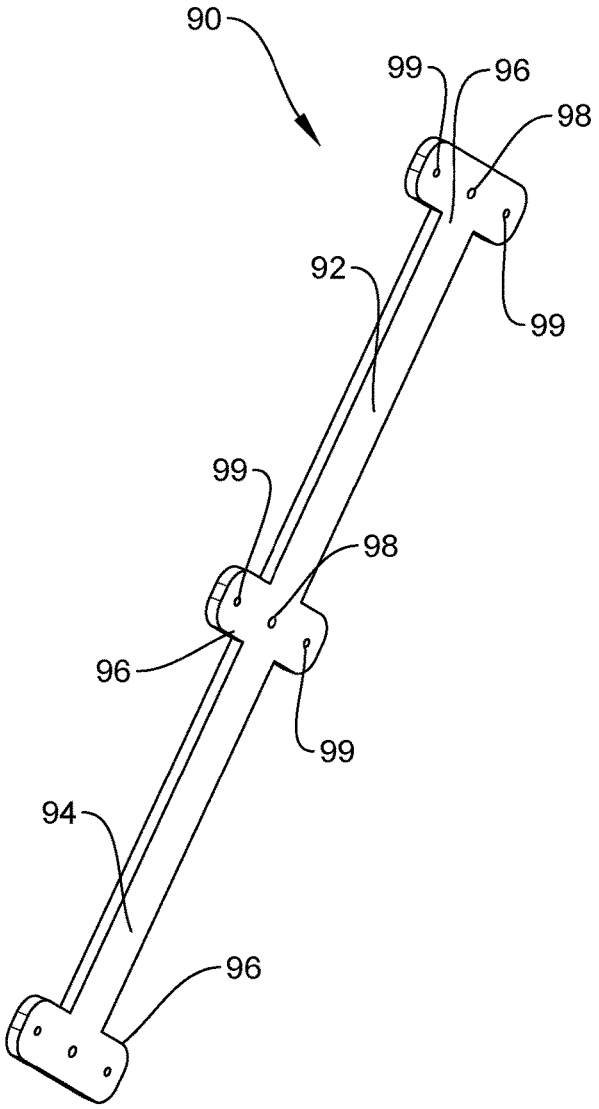
FIG. 8B illustrates a perspective view of the base plate.

As shown in FIGS. 8A and 8B, there may be provided an elongated base plate 90, which may be adapted for attaching to a base of the panel 12. The plate 90 may be constructed of a lightweight metal or alloy. Preferably, the plate 90 may be constructed of aluminium. The attachment may be a fastener 98 to secure the material 40 filled between the corrugation portion with the elongated base plate 90. The elongated base plate 90 may comprise a plurality of legs 96. The plurality of legs 96 may extend perpendicularly away from the longitudinal axis of the base plate 90. The legs 96 may be adapted for engaging a floor or platform of the room. Each leg 96 of the plurality of legs may have a surface engagement means 99 for securing each leg to the floor or platform or a surface. The surface engagement means 99 may be a fastener.

Figure 7A:
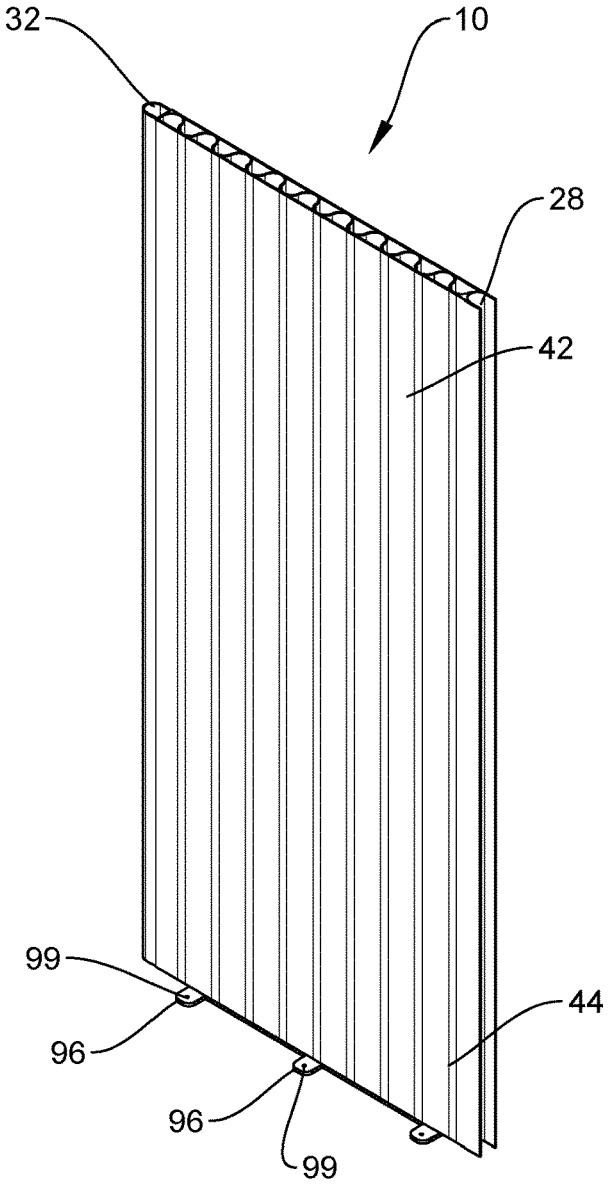
FIG. 7A illustrates a modular device of FIG. 1B engaged with a base plate.
Figure 7B:
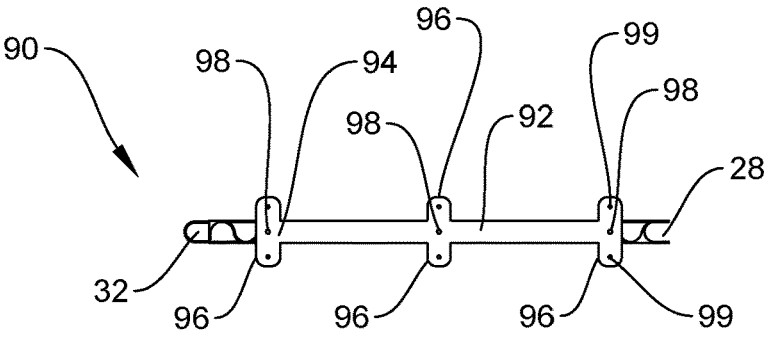
FIG. 7B illustrates a bottom view of FIG. 7A.

As shown in FIGS. 7A and 7B, the length of the elongated base plate 90 may be shorter than the length of the base of the panel 12. The elongated base plate 90 may have a female proximal end 92 and a male proximal end 94, wherein the female proximal end of the base plate 92 may be adapted to engage with a female proximal end of the base of the panel 12, wherein the female portion 28 of the panel 12 may be outside of the female proximal end 92 of the elongate base plate 90. The male proximal end 94 of the base plate 94 may be adapted to engage with a male proximal end of the base of the panel 12, wherein the male portion 32 of the panel 12 may be outside of the male proximal end 94 of the elongate base plate 90.

The panel may be constructed from at least one polymer selected from the group of: acrylonitrile butadiene styrene, polyethylene, polycarbonate, polyamide, high impact polystyrene, and polypropylene. The panel may be formed from at least one selected from the group of: extrusion, and injection moulding.

In another embodiment of the present invention, the module device 10 may further comprise an elongate U bracket along the longitudinal axis of the panel 12 (not shown). The base of the U bracket may be mountable to the ceiling of room space, and wherein the arms of the U bracket may be adapted to secure with the top portion of the panel 42. The top portion of the panel 42 may be secured by sliding the top portion to the U bracket.

In another embodiment of the present invention, the corrugation of the corrugated portion 14 may have a sinusoidal wavelength to amplitude ratio in the range of: 1:1 to 3:1. Preferably, the sinusoidal wavelength to amplitude ratio of about 2:1.

In another embodiment of the present invention, the height of the panel 12 may be in the range of: 1 metre to 3 metres, the length of the panel 12 may be in the range of: 1 metre to 4 metres, and the thickness of the panel may be in the range of: 20 millimetres to 80 millimetres. Preferably, the height of the panel 12 may be 1 metre, the length of the panel 12 is 2.4 metres, and the thickness of the panel is 50 millimetres.

When additional panels are engaging with the parts, the connection between the male and female portions may be glued for extra reinforcement. Once the glue is dried, it may be appreciated that the dried glue may not be level with the surface of the panel 12. The dried glue may be sanded such that the glued panels are level. The advantage of this modular device may be that it is significantly easier and cheaper to erect compared to conventional non-structural walls, which may be of gyprock and timber supports.

In further embodiments, the empty void space 40 between the corrugations of the panel may be backfilled with a non-structural filler agent such as expandable styrene foam. The non-structural filler may include materials that are flame retardant, fire retardant and/or noise absorbing.

Although the invention has been described with reference to specific examples, it will be appreciated by those skilled in the art that the invention may be embodied in many other forms, in keeping with the broad principles and the spirit of the invention described herein.

The present invention and the described preferred embodiments specifically include at least one feature that is industrial applicable.

The invention claimed is:

1. A modular device adapted for subdividing room space, the modular device comprising:

a panel comprising a corrugated portion positioned between a first planar surface and a second planar surface of the panel, wherein the peaks of the corrugated portion are in engagement with the first planar surface, wherein the troughs of the corrugated portion are in engagement with the second planar surface;

the first planar surface and the second planar surface each having a first end and a second end, wherein the first and second ends of the first planar surface are respectively opposite relatively to the first and second ends of the second planar surface;

the second planar surface is parallel to the first planar surface; wherein the corrugations are is parallel to the vertical axis of the panel;

a concave female portion positioned along the vertical axis in the panel, wherein the concave female portion is formed from at least: the first end of the first planar surface, the first end of the second planar surface, and a curved portion from the corrugated portion;

a convex male portion positioned along the vertical axis of the panel, wherein the convex male portion is positioned outside of the second end of the first planar surface and the second end of the second planar surface; wherein to extend the length of the panel, the convex male portion of a first panel is adapted to engage with the concave female portion of a second panel; and a corner portion comprising a female corner cap and an adjacent male part, the female corner cap having a space between first and second sides, the adjacent male part joined to the female corner cap at the first side and space, wherein the female corner cap is adapted to engage with the male portion of the front panel, wherein the adjacent male part is adapted to engage with the female portion of the next panel; and wherein the adjacent male part is extended outwardly from an outer surface of the female cap at an angle relative to the longitudinal axis of the length of the panel.

2. The modular device according to claim 1, further comprising a male cap, wherein the male cap is adapted to cover the female portion of the last panel.

3. The modular device according to claim 1, wherein the angle is 90° relative to the longitudinal axis of the length of the panel.

4. The modular device according to claim 1, further comprising an elongated base plate adapted for attaching to a base of the panel, wherein the length of the elongated base plate is shorter than the length of the base of the panel.

5. The modular device according to claim 4, wherein the elongated base plate having a first end and a second end, wherein the first end of the base plate is adapted to engage with a first end of the base of the panel, wherein the female portion of the panel is outside the first end of the base plate.

6. The modular device according to claim 5, wherein the second end of the base plate is adapted to engage with a second end of the base of the panel, wherein the male portion of the panel is outside the second end of the base plate.

7. The modular device according to claim 4, wherein the base plate comprises a plurality of legs extending perpendicularly away from the longitudinal axis of the base plate, wherein each leg of the plurality of legs has a floor securing means.

8. The modular device according to claim 1 wherein the panel is constructed from at least one polymer selected from the group of: acrylonitrile butadiene styrene, polyethylene, polycarbonate, polyamide, high impact polystyrene, and polypropylene.

9. The modular device according to claim 1, wherein the female portion further comprises a securing means positioned in the female portion.

10. The modular device according to claim 1, further comprising an elongate U bracket along the longitudinal axis of the panel, wherein a base of the U bracket is mountable to the ceiling of room space, and wherein the arms of the U bracket are adapted to secure with the top of the panel.

11. The modular device according to claim 1, wherein the panel is formed from at least one selected from the group of: extrusion, and injection moulding.

12. The modular device according to claim 1, further comprising a panel reinforcement positioned between the first planar surface and the second planar surface, wherein the panel reinforcement is polyurethane foam.

13. The modular device according to claim 1, wherein a sinusoidal wavelength to amplitude ratio of the corrugation is in the range of: 1:1 to 3:1.

14. The modular device according to claim 13, wherein the sinusoidal wavelength to amplitude ratio of the corrugation is 2:1.

15. The modular device according to claim 1, wherein the height of the panel is in the range of: 1 metre to 3 metres, the length of the panel is in the range of: 1 metre to 4 metres, and the thickness of the panel is in the range of: 20 millimetres to 80 millimetres.

16. The modular device according to claim 15, wherein the height of the panel is 1 metre, the length of the panel is 2.4 metres, and the thickness of the panel is 50 millimetres.

* * * * *